US005492438A

United States Patent [19]

Hilfiker

[11] Patent Number: 5,492,438

[45] Date of Patent: Feb. 20, 1996

[54] APPARATUS AND METHOD FOR RETAINING WALL TOP PANEL

[76] Inventor: William K. Hilfiker, 3718 Lakeridge Dr., Grapevine, Tex. 76051

[21] Appl. No.: 262,746

[22] Filed: Jun. 20, 1994

[51] Int. Cl.[6] ..... E02D 29/02

[52] U.S. Cl. ..... 405/285; 405/286; 52/583.1; 52/745.13

[58] Field of Search ..... 405/284, 285, 405/282, 250, 252; 52/223.7, 583.1, 741.15, 745.13

[56] References Cited

U.S. PATENT DOCUMENTS

| | | | |
|---|---|---|---|
| 1,004,145 | 9/1911 | Campfield . | |
| 2,035,050 | 3/1936 | Clare | 61/17 |
| 2,165,500 | 7/1939 | Muirhead | 72/0.5 |
| 2,815,656 | 12/1957 | Klein et al. | 72/16 |
| 3,546,720 | 12/1970 | Hoch et al. | 4/172.19 |
| 4,051,570 | 10/1977 | Hilfiker | 14/26 |
| 4,068,482 | 1/1978 | Hilfiker | 61/47 |
| 4,260,296 | 4/1981 | Hilfiker | 405/284 |
| 4,324,508 | 4/1982 | Hilfiker et al. | 405/284 |
| 4,343,572 | 8/1982 | Hilfiker | 405/284 |
| 4,391,557 | 7/1983 | Hilfiker et al. | 405/284 X |
| 4,494,892 | 1/1985 | Wojciechowski | 404/6 |
| 4,661,023 | 4/1987 | Hilfiker | 405/262 |
| 4,911,585 | 3/1990 | Vidal et al. | 405/287 |
| 4,929,125 | 5/1990 | Hilfiker | 405/286 X |
| 4,992,005 | 2/1991 | Hilfiker | 405/286 X |
| 4,993,879 | 2/1991 | Hilfiker | 405/262 |
| 5,044,833 | 9/1991 | Hilfiker | 405/286 X |
| 5,216,860 | 6/1993 | Thomson et al. | 52/583.1 X |
| 5,356,242 | 10/1994 | Elmore et al. | 405/285 X |

FOREIGN PATENT DOCUMENTS

| | | |
|---|---|---|
| 202626 | 8/1906 | Germany . |
| 242367 | 7/1910 | Germany . |

OTHER PUBLICATIONS

Texas Department of Highways, "Section Through C.I.P. Coping With T501 Barrier At Concrete Pavement," 1987.

Texas Department of Highways, "Precast Coping Detail @ T501 Barrier," 1987.

*Primary Examiner*—Roger J. Schoeppel

*Attorney, Agent, or Firm*—Limbach & Limbach

[57] ABSTRACT

A top panel for use with retaining walls for earthen formations is provided with anchors to secure the panel in place at the face of a formation and upwardly extending reinforcing bars to enable a concrete barrier to be formed on and secured to the panel. In the preferred embodiment, the anchors include soil reinforcing elements and connectors are provided intermediate the height of the panel for connection to the soil reinforcing element to the panels.

11 Claims, 1 Drawing Sheet

APPARATUS AND METHOD FOR RETAINING WALL TOP PANEL

BACKGROUND OF THE INVENTION

The present invention relates to the art of retaining walls for earthen formations and, more particularly, is concerned with a top panel for use on concrete retaining walls which complements the grade of the earthen formation and provides for the formation of a coping barrier directly on the panel. In its more specific aspects, the invention is concerned with the means whereby the panel is anchored to the earthen formation and provides reinforcements for a coping barrier which may be slip formed on the panel after it is in place on a wall.

The prior art teaches various caps or copings for use on retaining walls for earthen formations. One such cap is shown in U.S. Pat. No. 4,260,296 by William K. Hilfiker, the inventor herein, wherein a preformed cap is adjustably secured to the top of a retaining wall to accommodate different grades. Others are shown in U.S. Pat. Nos. 4,911,585 and 4,494,892 wherein preformed barriers are positioned on the top of the face elements for a retaining wall, with the barriers disposed to straddle the face elements. Still another example of a prior art curb or barrier is found in U.S. Pat. No. 4,051,570 by William K. Hilfiker. In the latter patent, the curbs take the form of preformed cap-like elements supported on crib walls. It is also known to use cap-like coping elements which straddle or overlap face panels and provide reinforcements to which a barrier may be formed in place.

The prior art also teaches a concept of securing the face panels of a retaining wall to the earthen formation being retained. An example of such an arrangement may be seen in U.S. Pat. No. 4,993,879 to William K. Hilfiker wherein welded wire soil reinforcing mats are secured to the face panels by loop-like connectors.

SUMMARY OF THE INVENTION

In its broadest aspects the present invention is concerned with a combination top panel and coping wherein the panel is secured to the earthen formation and provides means whereby a coping barrier may be cast in place directly on the panel, with reinforcing elements from the panel cast in place within the barrier. The panel has a generally horizontal lower surface for support on the face element of a panel disposed therebeneath. In the preferred embodiment, the panel has a width corresponding to that of the face element. The top surface of the panel may be inclined relative to the lower surface to complement the grade of the earthen formation being reinforced. Through the latter characteristic, the panel accommodates the grade of the formation and provides an inclined surface against which the coping barrier may be formed in place to complement the grade of the formation.

A principal object of the present invention is to provide a top panel for the face of the retaining wall which may accommodate the grade of an earthen formation and provide a base for a coping barrier which may be formed in place on the panel.

Another object of the invention is to provide such a panel having means to anchor it to the earthen formation being retained.

Still another object of the invention is to provide such a panel having reinforcing elements extending upwardly therefrom which may be cast in place within the coping barrier so as to secure the barrier integrally to the panel.

Yet another object of the invention is to provide such a panel which may be formed as a continuation of the face of a retaining wall to accommodate different grades, without the necessity of providing adjustment means between the panel and the face, or a skirt which overlaps the face.

The foregoing and other objects will become more apparent when viewed in light of the following detailed description and accompanying drawings.

DESCRIPTION OF THE PREFERRED EMBODIMENT

Figure 1:
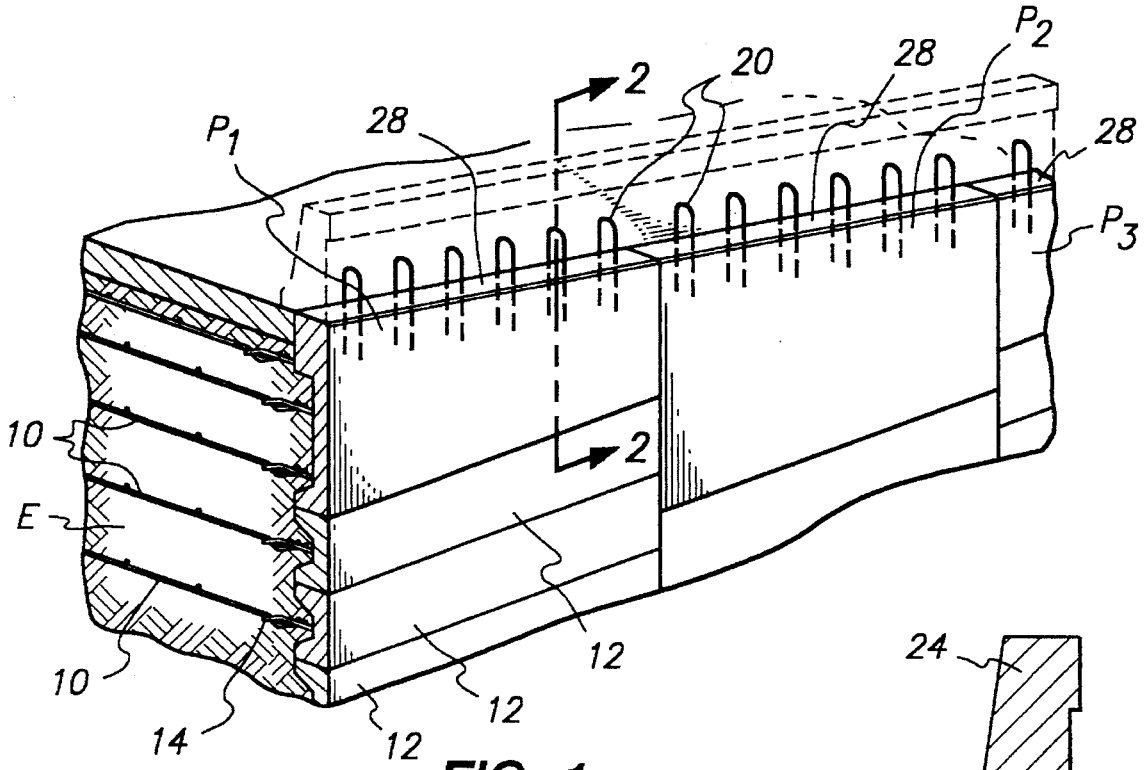
FIG. 1 is a perspective view of a retaining wall embodying top panels constructed according to the present invention, with phantom lines showing how a coping barrier may be formed in place on the panels.

Referring now to FIG. 1, the earthen formation being retained is designated by the letter "E" and is shown as being retained by a soil reinforced wall comprised of welded wire mats 10 embedded within the formation. Face panels 12 are secured to the mats 10 through connectors 14. The mats 10, panels 12 and connectors 14 and the manner in which they are placed within the formation to provide the wall may be as disclosed in U.S. Pat. No. 4,993,879 to William K. Hilfiker, the inventor herein.

Figure 3:
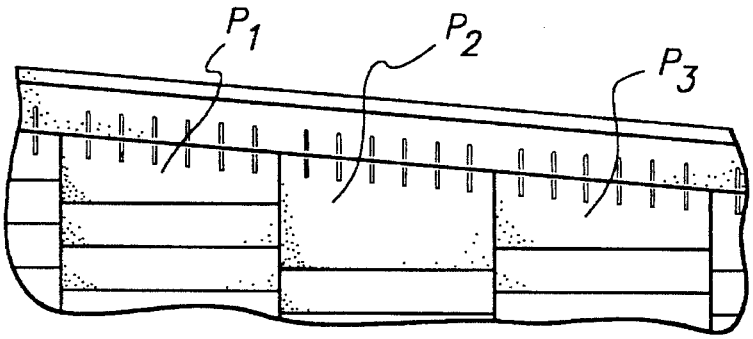
FIG. 3 is a front elevational view of a retaining wall embodying the top panels of the present invention, with a coping barrier cast in place on the wall; and, FIG. 4 is a perspective view of a top panel constructed according to the present invention, with the panel formed with architectural relief to correspond to that of a face disposed therebeneath and the end of the panel shown in section.
Figure 2:
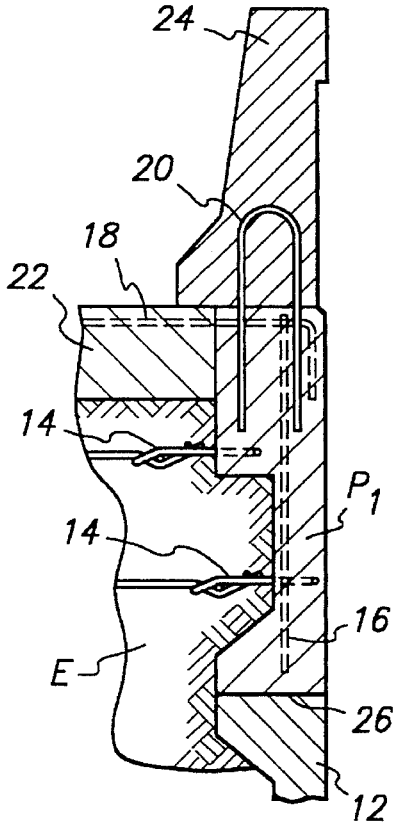
FIG. 2 is a cross-sectional elevational view taken on the plane designated by line 2—2 of FIG. 1, illustrating the panel of the present invention, with the coping barrier cast in place thereon.

The top panels of the present invention shown in FIGS. 1, 2 and 3 are designated by the letters quote "$P_1$," "$P_2$" and "$P_3$". These panels differ from one another only in their height. Their heights are selected so as to complement the grade of the earthen formation and accommodate the different levels of the topmost face panels disposed therebeneath. Each of the panels "$P_1$," "$P_2$" and "$P_3$" has a width corresponding to that of the face panel 12 therebeneath. The panels "$P_1$," "$P_2$" and "$P_3$" are formed of precast concrete having reinforcing bars 16, 18 and 20 embedded therein. The bars 16 extend generally vertically within the panels and may be of a gridwork configuration to enhance their reinforcement capability. The bars 18 extend laterally from the panels in order they may be cast in place within a pavement slab 22, as seen in FIG. 2, to secure the top panels to the slab. The bars 20 are of a generally inverted U-shaped configuration and extend upwardly from the top surface of the face panels to provide a means whereby a cast-in-place coping barrier 24 may be secured to the top panels.

The top panels "$P_1$," "$P_2$" and "$P_3$" also have connectors 14 cast in place therein and extending toward the earthen formation. These connectors correspond in construction to those used for the panels 12 and may be of the construction shown in U.S. Pat. No. 4,993,879. In use, they are connected to welded wire soil reinforcing mats 10.

Figure 4:
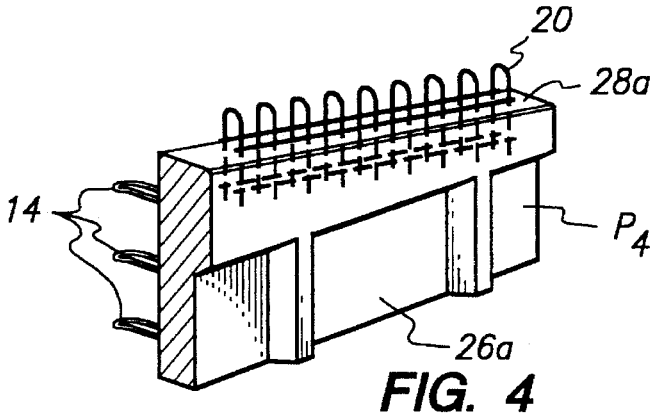

The top panel shown in FIG. 4 is designated by the "$P_4$" and differs from the panels "$P_1$," "$P_2$" and "$P_3$" only in that it is of a different architectural design to accommodate a similarly designed face panel upon which it would be supported. Such panels may be seen, for example, in U.S. Pat. No. 4,661,023 to William K. Hilfiker. The mat connectors and reinforcing bars of the FIG. 4 embodiment correspond to those of the FIGS. 1–3 embodiments and are designated by like numerals. Although the FIG. 4 embodiment is not shown as having reinforcing bars 16 and 18, it should be understood that such bars could be used in that embodiment if so desired.

The top panels of the FIGS. 1, 2 and 3 embodiments are formed with generally horizontal bottom surfaces 26 configured for support on and complemental engagement with the top surfaces of the face panels 12 disposed therebeneath. The top surfaces of the panels "$P_1$," "$P_2$" and "$P_3$," designated 28, are inclined relative to the bottom surfaces so as to complement the grade of the earthen formation being retained (see FIGS. 1 and 3). The bottom and top surfaces of the panel "$P_4$" shown in FIG. 4, designated 26*a* and 28*a*, respectively, are similarly disposed.

The wall on which the top panels of the present invention are used is constructed in generally the same manner as that shown in U.S. Pat. No. 4,993,879. As construction of the wall nears completion, the top panels of the present invention are chosen and placed so as to complement the grade of the formation and meet with the staggered rows of face panels. The top panels of the invention are secured to soil reinforcing mats in the same way as the panels of U.S. Pat. No. 4,993,879. Additionally, the panels may be secured to pavement 22 through means of the reinforcing bars 18, as shown in FIG. 2.

Once the top panels are in place and disposed at grade level, the coping barrier 24 may be cast in place over the reinforcing bars 20. Although any desired forming technique may be employed, slip forming is ideal, particularly for retaining walls used for highway construction.

CONCLUSION

While preferred embodiments have been illustrated and described, the invention is not intended to be limited to the specifics of these embodiments. For example, the cross section and architectural configuration of the top panels and the exact form of the reinforcements employed therein may vary. Accordingly, it should be understood that the invention may take any form within the scope of the accompanying claims.

I claim:

1. In a wall to retain an earthen formation, said wall being of the type having concrete panels stacked upon one another at the face of the formation and soil reinforcements secured thereto and embedded in the formation, the improvement comprising:

a) an improved top panel for the wall, said top panel having a thickness approximately equal to that of the stacked panels of the wall, a lower surface engageable with the uppermost of the panels stacked therebeneath and a top surface spaced from said lower surface;

b) concrete reinforcing elements fixed to the top panel and extending upwardly therefrom; and c) connectors secured to said panel intermediate the top and bottom surfaces thereof for attachment to soil reinforcements embedded in the earthen formation.

2. In a wall according to claim 1, the improvement further comprising a concrete barrier formed in place on the top surface of the top panel with the reinforcing elements embedded therein.

3. In a wall according to claim 2, the improvement further comprising soil reinforcing elements secured to said connectors and extending laterally from the top panel.

4. In a wall according to claim 1, wherein the earthen formation being retained has an inclined grade level, the improvement wherein the top surface of the top panel is complemental with said grade level.

5. A method of providing a top panel and curb on a retaining wall for an earthen formation wherein the wall is comprised of stacked panels disposed at the face of the formation, the uppermost of which panels is disposed below grade level of the formation, said method comprising:

a) providing a preformed top panel having a lower surface engageable with said uppermost panel for support thereon, an upper surface complemental to the grade level of the formation, concrete reinforcing elements extending upwardly from said upper surface, and a soil reinforcing element secured to the panel intermediate its upper and lower surfaces;

b) supporting said top panel on the uppermost of the stacked panels;

c) embedding the soil reinforcing element in the earthen formation; and d) forming a concrete barrier in place on the upper surface of top panel with the concrete reinforcing elements embedded in the barrier.

6. A wall for retaining an earthen formation, said wall comprising:

a) concrete panels stacked upon one another at the face of the formation;

b) means securing the panels in place at the face of the formation;

c) top panel for the wall supported on the uppermost of the stacked panels, said top panel having a thickness approximately equal to that of the stacked panels of the wall, a lower surface complementally engageable with said uppermost panel, and a top surface spaced from said lower surface;

d) concrete reinforcing elements fixed to the top panel and extending upwardly therefrom; and, e) soil connectors secured to said panel and extending therefrom into embedment with the earthen formation.

7. A wall according to claim 6, further comprising a concrete barrier formed in place on the top surface of the top panel with the reinforcing elements embedded therein.

8. A wall according to claim 7 wherein said connectors comprise soil reinforcing elements secured to and extending laterally from the top panel.

9. A wall according to claim 7, wherein the earthen formation being retained has an inclined grade level and the top surface of the top panel is complemental with said grade level.

10. A top panel for use with a retaining wall for an earthen formation, said panel comprising:

a) an elongate body having upwardly extending reinforcing bars to enable a concrete barrier to be formed on and secured to the panel; and, b) attachment means operatively associated with the body to secure the panel to an anchor embedded in the earthen formation.

11. A top panel according to claim 10 wherein the elongate body has a generally horizontal lower surface for support on wall structure disposed therebeneath and an upper surface inclined with respect to the lower surface to complement an inclined earthen formation with which the panel is used.

* * * * *